US009060568B2

(12) United States Patent
Dirsa et al.

(10) Patent No.: US 9,060,568 B2
(45) Date of Patent: Jun. 23, 2015

(54) ARTICLE OF FOOTWEAR WITH INSERTABLE LIGHTWEIGHT INTERIOR MIDSOLE STRUCTURE

(71) Applicant: Nike, Inc., Beaverton, OR (US)

(72) Inventors: David J. Dirsa, North Andover, MA (US); Tamara M. Peters, Portland, OR (US); Daniel A. Williamson, St. Paul, OR (US)

(73) Assignee: Nike, Inc., Beaverton, OR (US)

( * ) Notice: Subject to any disclaimer, the term of this patent is extended or adjusted under 35 U.S.C. 154(b) by 343 days.

(21) Appl. No.: 13/689,828

(22) Filed: Nov. 30, 2012

(65) Prior Publication Data

US 2013/0139410 A1 Jun. 6, 2013

Related U.S. Application Data

(60) Provisional application No. 61/566,201, filed on Dec. 2, 2011.

(51) Int. Cl.
*A43B 13/12* (2006.01)
*A43B 13/28* (2006.01)
(Continued)

(52) U.S. Cl.
CPC ..... *A43B 13/28* (2013.01); *A43B 13/12* (2013.01); *A43B 1/0027* (2013.01); *A43B 13/04* (2013.01); *A43B 13/125* (2013.01); *A43B 13/188* (2013.01)

(58) Field of Classification Search
CPC ..... A43B 13/00; A43B 13/02; A43B 13/12; A43B 13/125; A43B 13/127
USPC ..... 36/30 R
See application file for complete search history.

(56) References Cited

U.S. PATENT DOCUMENTS 2,410,019 A 10/1946 Davis
4,302,892 A 12/1981 Adamik
(Continued)

FOREIGN PATENT DOCUMENTS

EP 0 585 147 3/1994
EP 1 172 402 1/2002
(Continued)

OTHER PUBLICATIONS

PCT/US2007/012295, Annex to Partial International Search, dated Nov. 5, 2007.
(Continued)

*Primary Examiner* — Marie Bays
(74) *Attorney, Agent, or Firm* — Banner & Witcoff, Ltd.

(57) ABSTRACT

An article of footwear includes an upper that at least in part defines an interior chamber for receiving a foot; an insertable interior midsole component received within the interior chamber; and an exterior sole structure engaged with the upper, wherein the exterior sole structure includes: (a) an exterior midsole component and (b) optionally an outsole component that extends under the forefoot region, wherein the insertable interior midsole component is formed from a foam material comprising a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer, and at least one additive in an amount suitable to form the foam material; wherein the density of the foam material is less than 0.25 g/cm$^3$.

20 Claims, 5 Drawing Sheets

(51) Int. Cl.

| | |
|---|---|
| ***A43B 1/00*** | (2006.01) |
| ***A43B 13/04*** | (2006.01) |
| ***A43B 13/18*** | (2006.01) |

(56) References Cited

U.S. PATENT DOCUMENTS

| | | | | | |
|---|---|---|---|---|---|
| 4,364,188 | A | | 12/1982 | Turner et al. | |
| 4,364,189 | A | | 12/1982 | Bates | |
| 4,398,357 | A | | 8/1983 | Batra | |
| 4,399,620 | A | | 8/1983 | Funck | |
| 4,547,979 | A | | 10/1985 | Harada et al. | |
| 4,551,930 | A | | 11/1985 | Graham et al. | |
| 4,557,060 | A | | 12/1985 | Kawashima | |
| 4,642,911 | A | | 2/1987 | Talarico, II | |
| 4,654,983 | A | | 4/1987 | Graham et al. | |
| 4,667,423 | A | | 5/1987 | Autry et al. | |
| 4,730,402 | A | | 3/1988 | Norton et al. | |
| 4,759,136 | A | | 7/1988 | Stewart et al. | |
| 4,766,679 | A | | 8/1988 | Bender | |
| 4,876,053 | A | | 10/1989 | Norton et al. | |
| 4,905,382 | A | * | 3/1990 | Yung-Mao | 36/28 |
| 5,025,573 | A | | 6/1991 | Giese et al. | |
| 5,141,578 | A | | 8/1992 | Yang | |
| 5,191,024 | A | | 3/1993 | Shibata et al. | |
| 5,308,420 | A | | 5/1994 | Yang | |
| 5,318,645 | A | | 6/1994 | Yang | |
| 5,325,611 | A | | 7/1994 | Dyer et al. | |
| 5,346,964 | A | | 9/1994 | Shibata et al. | |
| 5,362,435 | A | | 11/1994 | Volpe | |
| 5,396,675 | A | | 3/1995 | Vincent et al. | |
| 5,435,077 | A | | 7/1995 | Pyle | |
| 5,435,078 | A | | 7/1995 | Pyle | |
| 5,572,805 | A | | 11/1996 | Giese et al. | |
| 5,575,089 | A | * | 11/1996 | Giese et al. | 36/30 R |
| 5,787,610 | A | | 8/1998 | Brooks | |
| RE35,905 | E | | 9/1998 | Vincent et al. | |
| 5,890,248 | A | | 4/1999 | Gee | |
| 5,918,385 | A | | 7/1999 | Sessa | |
| 5,921,004 | A | | 7/1999 | Lyden | |
| 6,023,857 | A | * | 2/2000 | Vizy et al. | 36/30 R |
| 6,061,929 | A | | 5/2000 | Ritter | |
| 6,082,024 | A | | 7/2000 | Del Biondi | |
| 6,205,683 | B1 | * | 3/2001 | Clark et al. | 36/30 R |
| 6,372,809 | B1 | | 4/2002 | Asai et al. | |
| 6,892,478 | B1 | | 5/2005 | Erickson et al. | |
| 7,941,938 | B2 | * | 5/2011 | Yu et al. | 36/25 R |
| 2002/0143077 | A1 | | 10/2002 | Sueda et al. | |
| 2004/0029987 | A1 | | 2/2004 | Sawai | |
| 2004/0067380 | A1 | | 4/2004 | Maeda et al. | |
| 2004/0181970 | A1 | * | 9/2004 | Covatch | 36/30 R |
| 2007/0033833 | A1 | | 2/2007 | Chang et al. | |
| 2007/0186446 | A1 | * | 8/2007 | Lafortune | 36/43 |
| 2008/0244926 | A1 | | 10/2008 | Yu et al. | |

FOREIGN PATENT DOCUMENTS

| | | |
|---|---|---|
| EP | 1880625 | 1/2008 |
| GB | 2007081 | 5/1979 |
| JP | 57-081301 | 5/1982 |
| JP | 61154503 | 7/1986 |
| JP | 07-278365 | 10/1995 |
| JP | 2002-34601 | 2/2002 |
| JP | 2002302565 | 10/2002 |
| JP | 2004161987 | 6/2004 |
| WO | 2006121069 | 11/2006 |

OTHER PUBLICATIONS

PCT/US2007/012295, International Preliminary Report on Patentability and Written Opinion, dated Dec. 11, 2008.

Japanese Patent Application No. 2011-277963, Notice of Reasons for Rejection, mailed May 16, 2011.

Japanese Patent Application 2009-122727, Notice of Reasons for Rejection, mailed Nov. 14, 2011.

EP Application No. 13 15 8256.1-1303, European Search Report, dated Jul. 4, 2013.

EP Application 13 15 8254.6-1303, European Search Report, dated Jul. 2, 2013.

* cited by examiner

ARTICLE OF FOOTWEAR WITH INSERTABLE LIGHTWEIGHT INTERIOR MIDSOLE STRUCTURE

CROSS-REFERENCE TO RELATED APPLICATIONS

The present invention claims priority to U.S. provisional application Ser. No. 61/566,201 filed Dec. 2, 2011, which is hereby incorporated by reference in its entirety.

FIELD OF INVENTION

The present invention relates to the field of footwear. More specifically, aspects of the present invention pertain to articles of footwear that include an insertable (removable) interior midsole component prepared from lightweight material.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces and absorbing energy, the sole structure may provide traction and control foot motions, such as pronation. Accordingly, the upper and the sole structure operate cooperatively to provide a comfortable structure that is suited for a variety of ambulatory activities, such as walking and running. The general features and configuration of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system is often incorporated into the upper to selectively change the size of the ankle opening and permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

Various materials may be utilized in manufacturing the upper. The upper of an article of athletic footwear, for example, may be formed from multiple material layers that may include, for example, an exterior layer, a middle layer, and an interior layer (that fully or partially overlap). The materials forming the exterior layer (or other layers) of the upper may be selected based upon the properties of wear-resistance, abrasion resistance, flexibility, stretchability, and air-permeability, for example. With regard to the exterior layer, the toe area and the heel area may be formed of leather, synthetic leather, or a rubber material to impart a relatively high degree of wear-resistance and abrasion resistance. Leather, synthetic leather, and rubber materials, however, may not exhibit the desired degree of flexibility and air-permeability. Accordingly, various other areas of the exterior layer of the upper may be formed from a synthetic textile. The exterior layer of the upper may be formed, therefore, from numerous material elements that each imparts different properties to specific areas of the upper.

A middle (or other) layer of the upper may be formed from a lightweight polymer foam material that improves overall comfort and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

The sole structure generally incorporates multiple layers that are conventionally referred to as an insole, a midsole, and an outsole. The insole (which also may constitute a sock liner) is a thin member located within the upper and adjacent the plantar (lower) surface of the foot to enhance footwear comfort, e.g., to wick away moisture. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane or ethylvinylacetate ("EVA") that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

There are several types of materials used to prepare midsoles. These include ethylene vinyl acetate (EVA), materials containing EVA, for example Phylon and Phylite, polyurethane and materials containing polyurethane. Ethylene vinyl acetate (EVA) is soft, light, and flexible. It is the least expensive midsole material and is often used in entry-level shoes. Midsoles are cut and shaped from flat sheets of EVA foam. EVA will compress and become flat over time as the air trapped within the foam is squeezed out. Once EVA is compacted, it does not return to its original shape and no longer provides cushioning. EVA compresses faster than other midsole materials. Phylon is made of EVA foam pellets, slabs, or sheets that are compressed, heat expanded, and then cooled in a mold. Compression-molded Phylon midsoles can be sculpted into a variety of designs that can be identified by their fine wrinkles Phylon is very lightweight, low-profile, and responsive. Phylite is an injection-molded unit made of a combination of 60% Phylon and 40% rubber. Phylite is lighter than rubber, but heavier than Phylon and functions as both midsole and outsole. Polyurethane is a dense, durable, and stable midsole material. Typically, polyurethane is poured into a mold to create a firm midsole that provides maximum protection from impact. Polyurethane is identified by its smooth rubbery feel and tendency to turn yellow with age. Polyurethane is the heaviest midsole material, but it is also the most durable.

One type of midsole configuration is described in U.S. Pat. No. 7,941,938. This midsole has a first portion having a lower ground engaging surface, an upper surface, and a recess formed in the upper surface, the upper surface of the first portion in contact with the upper; and a second portion is seated in the recess in the first portion. The second portion is formed from a first foam material comprising a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer.

SUMMARY

This Summary is provided to introduce some concepts relating to this invention in simplified forms that are further described below in the Detailed Description. This Summary is not intended to identify key features or essential features of the invention.

The present invention pertains to articles of footwear that include both interior and exterior midsole components. More specifically, at least some aspects of this invention relate to articles of footwear including a rearfoot region, a midfoot region, and a forefoot region, wherein the article of footwear comprises: (a) an upper that at least in part defines an interior chamber for receiving a foot; (b) an interior midsole component received within the interior chamber; and (c) an exterior sole structure engaged with the upper. This exterior sole structure may include: (a) an exterior midsole component and (b) optionally an outsole component. The outsole component may extend under the exterior midsole component in the rearfoot region, forefoot region or both.

Additional aspects of this invention relate to foot-receiving devices that include: (a) a foot-covering component (akin to the footwear upper) that at least in part defines an interior chamber for receiving a foot; (b) an interior midsole component received within the interior chamber; and (c) a foot-supporting component (akin to the footwear exterior sole structure) engaged with the foot-covering component, wherein the foot-supporting component includes: (i) an exterior midsole component and (ii) optionally, a base support component (akin to the footwear outsole component) that extends under the rearfoot region, forefoot region or both.

Still additional aspects of this invention relate to methods for making articles of footwear of the types described above. Such methods may include: (a) engaging an upper of the types described above with an exterior sole structure of the types described above, and (b) inserting an interior midsole component of the types described above into the interior chamber defined at least in part by the upper.

The insertable interior midsole component includes lightweight foam and optionally a cloth or sockliner-type material adhered to the top surface of the lightweight foam which may also be called an insole. The insertable interior lightweight midsole component is prepared from a foam material formed from a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer. The exterior midsole component may be made of any suitable material such as phylon or polyurethane and optionally a cloth or sockliner-type material is adhered to the top surface of the exterior midsole component.

DESCRIPTION OF THE DRAWINGS

The foregoing Summary of the invention, as well as the following Detailed Description of the invention, will be better understood when read in conjunction with the accompanying drawings in which like reference numerals refer to similar elements in all of the various views in which that reference number appears.

DETAILED DESCRIPTION

Figure 1:
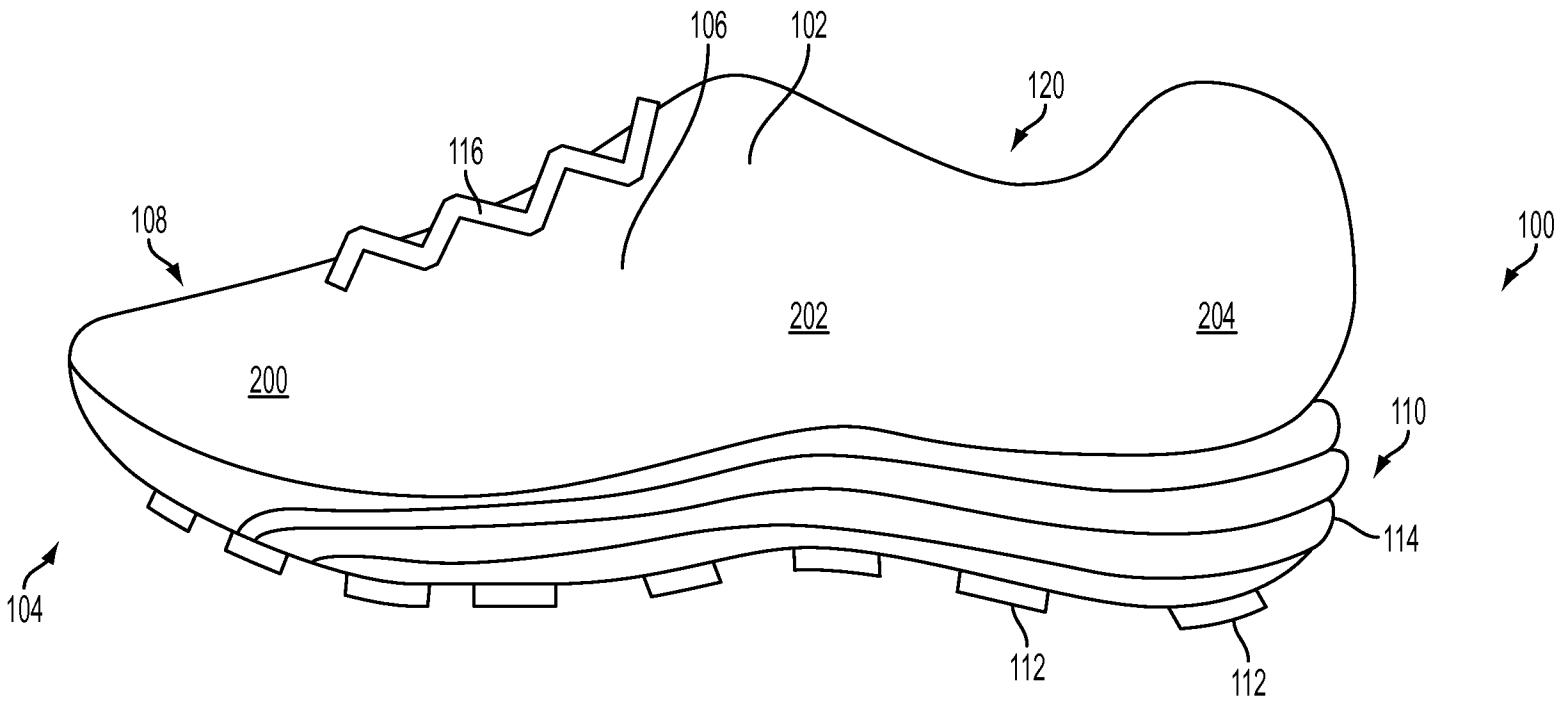
FIG. 1 is a side view of an article of footwear suitable for use with aspects of the invention.

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and components without departing from the scope of the present invention.

I. GENERAL DESCRIPTION OF ASPECTS OF THIS INVENTION

Aspects of this invention relate to articles of footwear that include interior midsole and exterior midsole components. The exterior midsole component is permanently attached to the upper (or other footwear structure). The interior midsole component is insertable/removable and lightweight. More specifically, at least some aspects of this invention relate to articles of footwear including a rearfoot region, a midfoot region, and a forefoot region, wherein the article of footwear comprises: (a) an upper that at least in part defines an interior chamber for receiving a foot; (b) an insertable lightweight interior midsole component received within the interior chamber; and (c) an exterior sole structure including (i) an exterior midsole component and (ii) optionally an outsole component that extends under the forefoot region, the rearfoot region, or both.

The exterior midsole component may take on a variety of different specific constructions and have a variety of different specific properties and/or materials without departing from this invention. The exterior midsole component may be a single molded piece or several pieces combined together such as a plurality of support elements separated by spaces (e.g., two or more foam columns, cylinders, or the like). The exterior midsole component may constitute a foam layer (e.g., synthetic polyurethane foams, rubber materials, ethylvinylacetate materials, etc.). In yet other example constructions, the exterior midsole component may include a fluid-filled bladder, optionally one that is fully or partially contained within a foam material (e.g., of the types mentioned above) or a cage element. The exterior midsole component also may include one or more mechanical shock absorbing or impact force attenuating members.

The exterior sole structure may also include an outsole component that extends under the forefoot region, the rearfoot region, or both. For example, infant and toddler shoes may not include such an outsole component whereas shoes made for older children and adults will likely contain include an outsole component for contact with the ground. The inclusion of an outsole component and/or its features may be dependent, at least in part, on the intended use of the shoe.

The interior midsole component also may take on a variety of different constructions and have a variety of different properties and/or materials without departing from this invention. The interior midsole component may be made, at least in part, from a lightweight foam material.

Also, if desired, a top surface of the insertable lightweight interior midsole component (e.g., the surface that will be located closest to the wearer's foot in the final footwear construction) may include a fabric element that optionally will contact the wearer when the shoe is worn. This fabric element may function similar to an insole member or sock liner (e.g., to help wick away moisture, provide a soft or comfortable feel, etc.). The fabric element may be attached to an upper surface of the insertable lightweight midsole component, e.g., by adhesives, stitching, or the like.

Alternatively, if desired, a separate insole or sock liner may be provided in the footwear interior chamber as a top surface of the exterior midsole component. This fabric element may function similar to an insole member or sock liner (e.g., to help wick away moisture, etc.) or to provide a non-slip surface for the interior midsole component. The fabric element may be attached to an upper surface of the exterior midsole component, e.g., by adhesives, stitching, or the like.

Additional aspects of this invention relate to making articles of footwear of the types described above (and described in more detail below). Such methods may include, for example: (a) engaging an upper of the various types or constructions described above with an exterior sole structure of the various types or constructions described above to thereby form a base footwear member including an interior foot-receiving chamber; and (b) inserting an insertable lightweight interior midsole component into the interior foot-receiving chamber.

In addition to articles of footwear, aspects of this invention can be practiced with other types of "foot-receiving devices" (i.e., any device into which a user places at least some portion of his or her foot). In addition to all types of footwear or shoes, foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to the footwear upper) that at least in part defines an interior chamber for receiving a foot; (b) an insertable lightweight interior midsole component received within the interior chamber; and (c) a foot-supporting component (akin to the footwear exterior midsole component and/or outsole component) engaged with the foot-covering component.

The term "insertable" when used in conjunction with the lightweight midsole component means the midsole component is an element separate from, and unattached to, the upper and the exterior sole structure. The lightweight midsole component is not a permanent part of the shoe, but may be inserted into, and removed from, the interior chamber defined at least in part by the upper.

Aspects of the invention utilize hydrogenated foams for the insertable lightweight interior midsole component. Further aspects relate to use of a foamed material with a spongy feel (like walking on the Moon or marshmallows) for the insertable lightweight interior midsole component.

Given this general description of features, aspects, structures, and arrangements according to the invention, a more detailed description of specific example articles of footwear and/or other foot-receiving devices in accordance with this invention follows.

II. DETAILED DESCRIPTION OF EXAMPLE ARTICLES OF FOOTWEAR ACCORDING TO THIS INVENTION

Referring to the figures and following discussion, various articles of footwear and features thereof in accordance with the present invention are disclosed. The footwear depicted and discussed are athletic shoes, and the concepts disclosed with respect to this footwear may be applied to a wide range of athletic footwear styles, including, but not limited to: walking shoes, tennis shoes, soccer shoes, football shoes, basketball shoes, running shoes, and cross-training shoes. In addition, the concepts of the present invention may be applied to a wide range of non-athletic footwear, including work boots, sandals, loafers, and dress shoes. Moreover, while aspects of this invention may be used on any size shoes, at least some aspects of this invention may have particular usefulness and relevance in footwear for children and those just learning to walk, including infant, baby, toddler, pre-school, and youth sizes (e.g., U.S. sizes 0 to 13.5 (children) and U.S. sizes 1 to 6 (youth)). Accordingly, the present invention is not limited to the precise embodiments disclosed herein, but applies to footwear generally.

An article of footwear suitable for use with aspects of the invention is shown in FIG. 1. Footwear 100 includes an upper 102 and an exterior sole structure 104 secured to upper 102. Footwear 100 has a medial, or inner, side 106 and a lateral, or outer, side 108. The upper member 102 and the exterior sole structure 104 may be engaged with one another in any suitable or desired manner without departing from this invention, including in conventional manners as are well known and used in the art, such as via adhesives or cements, sewing or stitching, mechanical connectors, etc.

Sole structure 104, which is generally disposed between the foot of the wearer and the ground, attenuates ground reaction forces, provides traction, and may control foot motions, such as pronation.

Upper 102 may be made of conventional materials and conventional constructions that are known and used in the art (e.g., foam materials, synthetic textiles, and leather that are stitched or adhesively bonded to each other to form a comfortable structure for receiving a foot).

Sole structure 104 includes an exterior midsole component 110 that forms one primary impact-force absorption layer of footwear 100 and serves, therefore, to attenuate ground reaction forces and absorb energy when footwear 100 is compressed against the ground. The exterior sole structure 104 may include an outsole 112 that forms the primary ground-contacting surface of footwear 100. The outsole 112 may be fashioned from a wear-resistant material, such as carbon black rubber compounds, and it may include texturing or other features to enhance traction.

During running or other activities that compress sole structure 104 between the foot and the ground, footwear 100 attenuates ground reaction forces and absorbs energy that otherwise would be transferred to the leg and foot of the wearer. The degree of impact force attenuation provided by footwear 100 is generally related to the overall stiffness of sole structure 104. In general, a greater stiffness provides a harder feel to the wearer, whereas lesser stiffness corresponds with a softer feel.

In this specification, various elements of articles of footwear will be discussed in detail. To aid in the following discussion, footwear may be divided into three general regions: a forefoot region 200 that generally corresponds with a front portion of the foot, including the toes; a midfoot region 202 that generally corresponds with a middle portion of the foot that includes the arch; and a heel or rearfoot region 204 that generally corresponds with the heel. Forefoot region 200 may be considered to encompass a ball region and a toe region of the footwear (wherein the ball region generally extends under the ball of the foot and the toe region generally extends under the toes of the foot). Regions 200, 202, and 204 are not intended to demarcate precise areas of an article of footwear. Instead, regions 200, 202, and 204 are intended to define general areas that aid in the following discussion. Additionally, although regions 200, 202, and 204 above are generally described with respect to an overall article of footwear, references to these same general regions 200, 202, and 204 also may apply to any part or individual component of an article of footwear, such as the upper, an insole or sock liner, a midsole, an outsole, an overall sole structure, etc.

Unless otherwise stated, or otherwise clear from the context below, directional terms used herein, such as rearwardly, forwardly, top, bottom, inwardly, downwardly, upwardly, etc., refer to directions relative to footwear 100 itself. Footwear is shown in FIG. 1 to be disposed substantially horizontally, as it would be positioned on a horizontal surface when worn by a wearer. However, it is to be appreciated that footwear 100 need not be limited to such an orientation. Thus, in the illustrated embodiment of FIG. 1, rearwardly is toward heel portion 204, that is, to the right as seen in FIG. 1. Naturally, forwardly is toward forefoot portion 200, that is, to the left as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly is toward the center of footwear 100, and outwardly is toward the outer peripheral edge of footwear 100.

One or more substantially horizontal ribs 114 may be formed on the exterior of sole structure 104. In certain embodiments, ribs 114 extend from a central area of forefoot portion 200 on medial side 106 rearwardly, around heel portion 204 and forwardly on lateral side 108 to a central lateral area of forefoot portion 200. Any system of horizontal ribs 114 may be used (e.g., any desired number of ribs, rib dimensions, rib patterns, etc.).

The upper member 102 may be made from any desired material(s) and/or construction(s) without departing from this invention, including conventional materials and constructions as are known and used in the footwear art. As some more specific examples, the upper member 102 may be made from one or more parts including fabric pieces, textile pieces, leathers, polymers, and the like. The various materials may be natural or synthetic, and appropriate materials may be provided at various locations in the upper member 102 to control various properties of the upper member 102, such as its color, style, aesthetic design, stiffness, flexibility, support, breathability, abrasion resistance, wear resistance, or the like.

The upper member 102 defines an opening 120 in the ankle area (over the heel region 204) that provides access to an interior foot chamber for receiving a wearer's foot during use. The upper member 102 may be closed off (e.g., with a strobel sock, strobel board, lasting board, or other lasting or bottom member; by extension of the lateral and medial side materials of the upper member 102 around the bottom; etc.) so that the upper member 102 itself defines the entire interior foot-receiving chamber. Alternatively, if desired, the upper member 102 may have an open bottom or a partially open bottom such that it partially defines the interior foot chamber and such that a top of the exterior sole member 104 defines a portion of the interior foot-receiving chamber. The interior foot-receiving chamber defined by this upper member 102 may be somewhat larger than conventional foot-receiving chambers of conventional shoes to accommodate the interior midsole component to be described in more detail below.

The size of the ankle opening 120 may be selectively controlled, at least in part, through a footwear securing mechanism, such as laces 116. While laces 116 are shown, any other desired type of securing mechanism may be used without departing from this invention, including straps, buckles, zippers, hook-and-loop fasteners, and the like, including securing mechanisms and securing systems as are conventionally known and used in the art.

The exterior sole structure 104 shown in FIG. 1 includes an exterior midsole component 110 and an outsole component 112 (each of which may be made from one or more individual parts). The exterior midsole component 110 of this example structure may be of any suitable structure. The structure may comprise a single molded piece (e.g., from a foam material, such as polyurethane foam or ethylvinylacetate foam materials) or multiple structural pieces connected together of varying hardness and stiffness such as a polymeric base plate made from PEBAX® (a thermoplastic polyester elastomer manufactured by Elf Atochem) that may be used along with a foam component.

The outsole component 112 of this example footwear structure 100 may cover part of the bottom of the shoe, for example in the heel region or the forefoot region, or it may cover substantially the entire bottom of the shoe (at least 90% of the bottom surface) and extend throughout the forefoot, midfoot, and heel regions. If desired, the outsole component 112 may cover the entire bottom surface of the shoe. Also, if desired, the outsole component 112 may be made from multiple pieces, and distinct gaps may be provided between the pieces. For example, the outsole component 112 may include one or more pieces in the forefoot and rearfoot regions while a gap in the outsole component is present in the midfoot region. Gaps in the outsole component 112 also may be selectively located to affect the flexibility of the overall sole structure 104 (e.g., the amount of flexibility, the force required to initiate flex, the location of flex, the direction of flex, etc.).

Figure 2A:
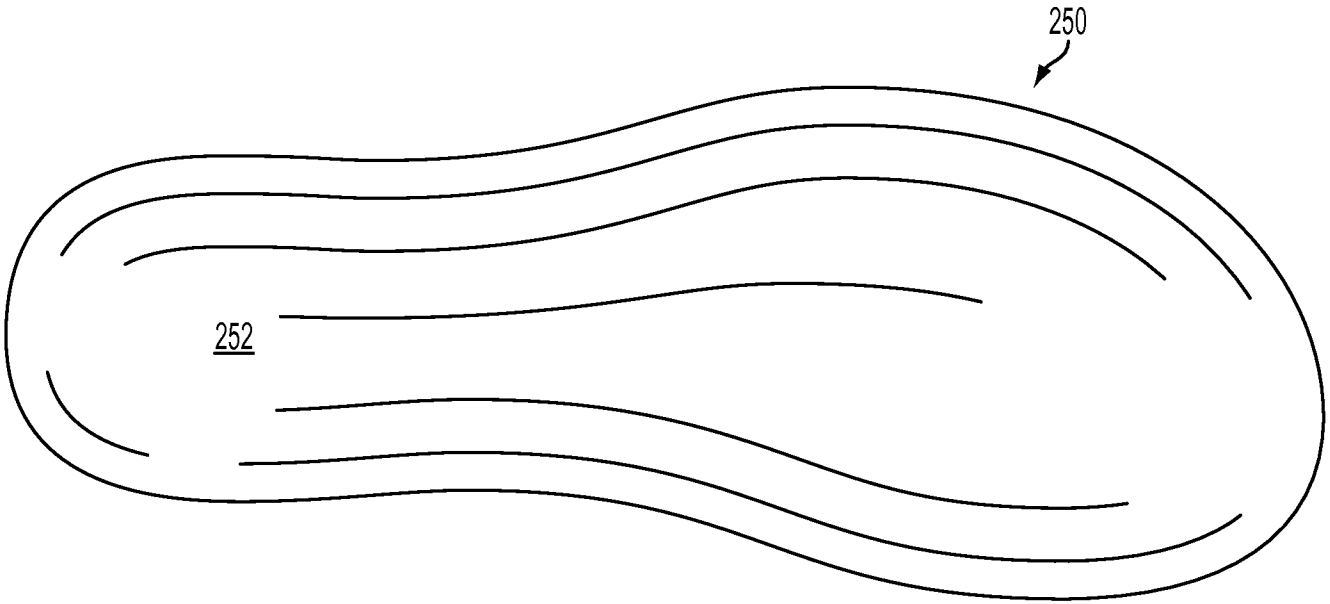
FIGS. 2A, 2B, 2C, and 2D are top, bottom, medial side, and lateral side views, respectively, of one aspect of the invention.
Figure 2B:
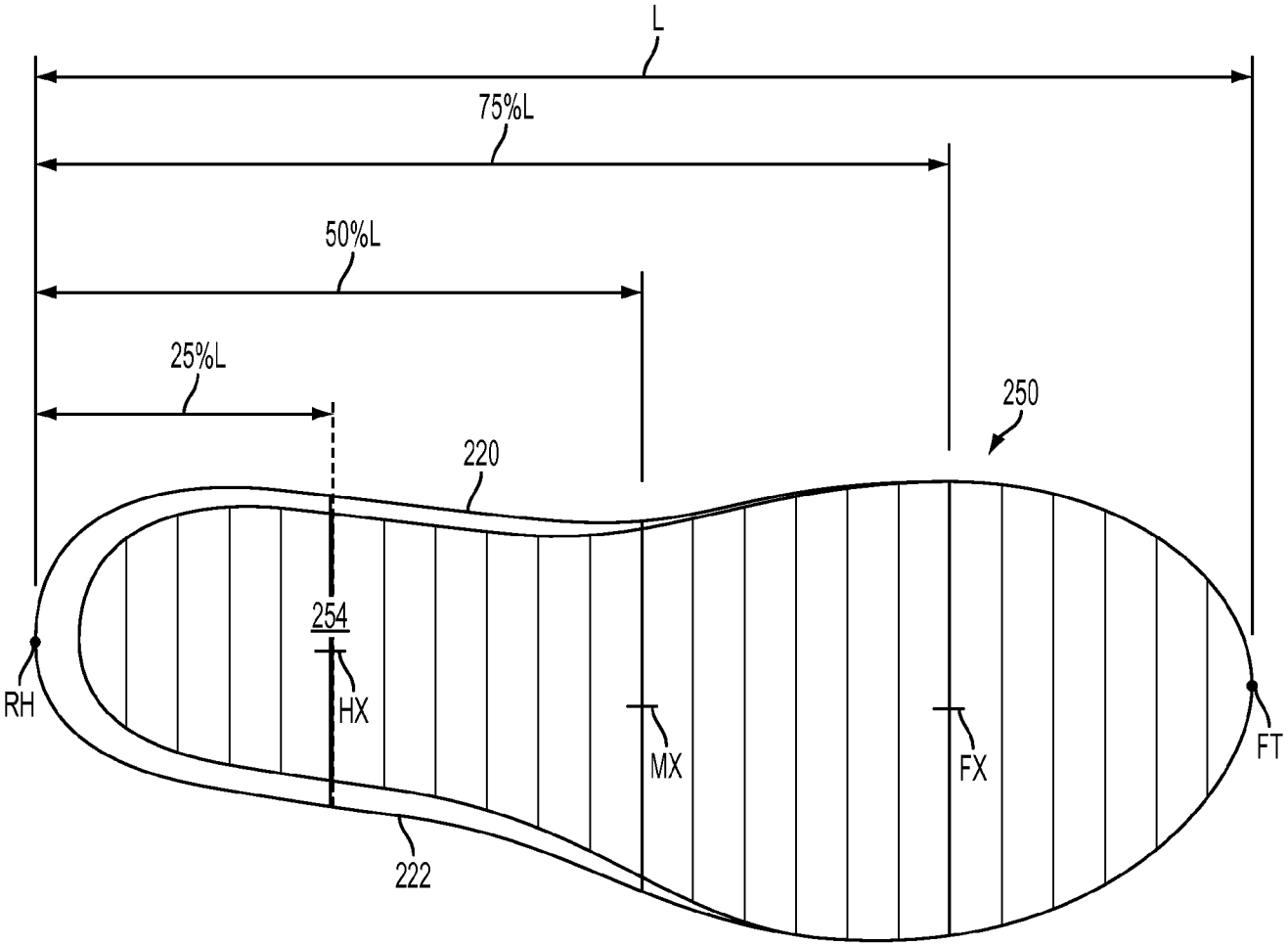

An aspect of the present invention is shown in FIGS. 2A-2D. More specifically, FIGS. 2A-2D illustrate an interior midsole component 250 that may be received within the interior foot-receiving chamber of the shoe 100 (e.g., through opening 120). As shown in these figures, interior midsole component 250 includes a top surface 252 (FIG. 2A) that supports the foot during use and a bottom surface 254 (FIG. 2B). The interior midsole component 250 is constructed from an impact force attenuating material to provide a soft and comfortable foot-support surface. The interior midsole component 250 may be made from one or more independent pieces, and the piece(s) may be formed in any desired manner without departing from the invention, including through the use of injection molding or blow molding processes. As shown in these figures, the interior midsole component 250 may cover or substantially cover the bottom of the entire foot-receiving chamber of the article of footwear 100 and thus fully support the wearer's foot when placed in the article of footwear 100. Also, the interior midsole component 250 is releasably and removably received in the shoe's interior chamber.

Because it is contained within the footwear's interior chamber (and thus substantially protected from exterior elements and forces), the material of the interior midsole component 250 may be somewhat more fragile, softer, and/or less dense than materials of any foam component making up the exterior midsole component. At least some of the interior midsole component 250 may be made from a foam material having a density of less than 0.25 g/cm$^3$, as described in U.S. Pat. No. 7,941,938, which patent is entirely incorporated herein by reference.

As some more specific examples and as described in U.S. Pat. No. 7,941,938 mentioned above, in at least some structures in accordance with this invention, all, substantially all, or at least some portion of the interior midsole component 250 may include a foam material comprising a reaction product of about 10 to about 100 parts per hundred hydrogenated or non-hydrogenated acrylonitrile butadiene copolymer, 0 to about 40 parts per hundred modified hydrogenated acrylonitrile butadiene copolymer, and 0 to about 90 parts per hundred alpha olefin copolymer, and at least one additive in an amount suitable to form the foam material. This foam material may have a lightweight, spongy feel.

The density of the foam material may be generally less than 0.25 g/cm$^3$, less than 0.20 g/cm$^3$, less than 18 g/cm$^3$, less than 0.15 g/cm$^3$, less than 0.12 g/cm$^3$, and in one aspect, about 0.10 g/cm$^3$. As an example range, the foam density may fall within the range, for example, of 0.05 to 0.25 g/cm$^3$, and in some examples from 0.10 to 0.2 g/cm$^3$, or even from 0.14 to 0.18 g/cm$^3$.

Also, in accordance with at least some examples of this invention, the resiliency of the foam material for the interior midsole component 250 may be greater than 40%, greater than 45%, at least 50%, and in one aspect from 50-70%.

Compression set may be 60% or less, 50% or less, 45% or less, and in some instances, within the range of 20 to 60%.

The hardness (Durometer Asker C) of the foam material may be, for example, 25 to 50, 25 to 45, 25 to 35, 35 to 45, 40-44, e.g., depending on the type of footwear.

The tensile strength of the foam material may be at least 15 kg/cm$^2$, and typically 15 to 40. The elongation % is 150 to 500, typically above 250.

The tear strength is 6-15 kg/cm, typically above 7.

In at least some example constructions according to the invention, the foam material of at least some portion of the interior midsole component 250 may have lower energy loss and may be more lightweight than traditional EVA foams. The energy loss may be less than 30%, and optionally within the range of about 20% to about 30%. As additional examples, if desired, at least some portion of the interior midsole component 250 may be made from foam materials used in the LUNAR family of footwear products available from NIKE, Inc. of Beaverton, Oreg.

Figure 2C:
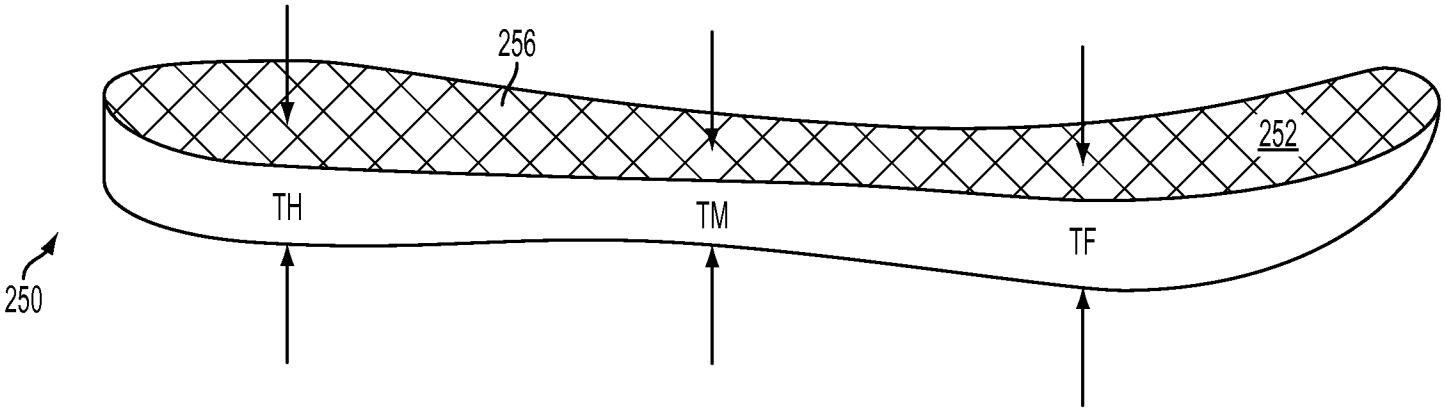
Figure 2D:
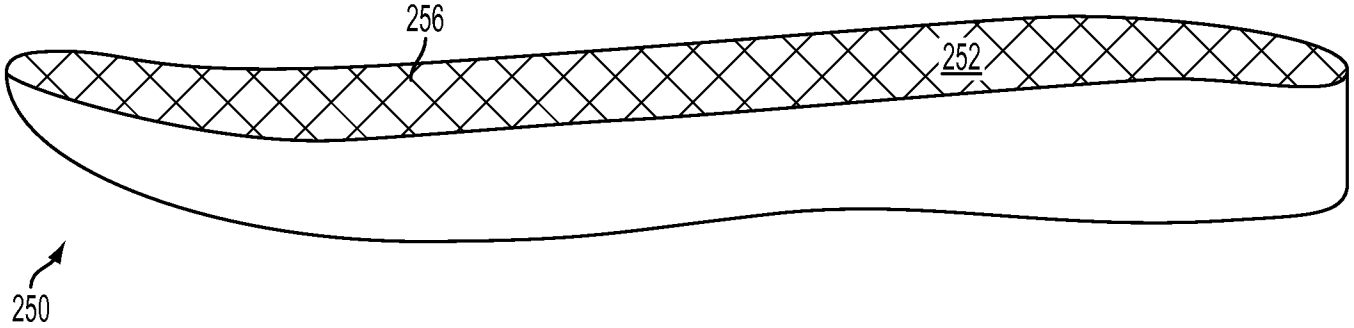

FIGS. 2C and 2D show the profile (medial and lateral sides) of this example interior midsole component 250. In the heel region, the interior midsole component 250 thickness TH may vary within a range of 4 to 25 mm, and in some examples from 4 to 22 mm, from 4 to 20 mm, or even from 4 to 15 mm (e.g., depending on the overall shoe size). The heel area of the shoe (which typically absorbs the initial impact force of a step cycle) includes the exterior midsole component 110. The exterior midsole component 110 may primarily absorb the impact forces and energy (with minor contributions from the interior midsole component 250). Hence the heel region of the interior midsole may be thinner. On the other hand, the heel region of the interior midsole may be thicker if additional impact force attenuation is desired or if the exterior midsole component 110 does not provide the primary absorption of the impact forces and energy.

In the midfoot region, the interior midsole component 250 thickness TM may vary within a range of 3 to 20 mm, and in some examples from 3 to 15 mm, from 3 to 12 mm, or even from 3 to 8 mm (e.g., depending on the overall shoe size). Either or both of the exterior midsole component 106 (e.g., a midsole wedge, if any) and the interior midsole component 250 may absorb the impact forces and energy in the midfoot region.

In the forefoot region, the interior midsole component 250 thickness TF varies, e.g., within a range of 1 to 15 mm, and in some examples from 1 to 12 mm, from 1 to 8 mm, or even from 1 to 6 mm (e.g., depending on the overall shoe size). The interior midsole component 250 may be the primary impact force and energy absorbing component in the forefoot region of this example article of footwear 100. Alternatively, the exterior midsole component 106 may be the primary impact force and energy absorbing component in the forefoot region and the interior midsole component may be thinner as a result.

While useful for any desired types or styles of shoes, aspects of this invention may be of particular interest for children's shoes (e.g., for infants, toddlers, pre-school aged children, elementary school aged children, and/or middle school aged children). Conventional children's shoes can be relatively stiff and firm, particularly in the forefoot area, because the foam or other midsole member (if any) typically is located outside the foot-receiving chamber. Thus, the child typically stands on a relatively thin sock liner or insole member that is located over a relatively stiff and hard lasting board. Because of the child's relatively light weight and limited mobility (at least for very young children), the external foam or other midsole member provides little comfort to the forefoot area of the foot. Moreover, the forefoot area is quite stiff due to its construction, particularly for small children that are just beginning to learn to walk.

In accordance with the present invention, however, the interior midsole component may be relatively thick and soft, particularly in the heel region. This interior midsole component is located within the foot-receiving chamber and provides a soft, comfortable surface in direct contact with the wearer's (e.g., a child's) foot.

FIGS. 2B and 2C provide information to assist one in determining where thickness measurements in accordance with this aspect of the invention may be made. For the central heel location measurement, in accordance with this aspect of the invention, the central heel location is located: (a) forward, in a longitudinal direction, from the rearmost heel RH location a distance of 25% of the overall longitudinal length L of the interior midsole component 250 and (b) at a midpoint HX along a line perpendicular to the longitudinal direction and directly connecting the medial side edge 220 and the lateral side edge 222 of the interior midsole component 250 at the 25% longitudinal length location. For the central midfoot location measurement, in accordance with this aspect of the invention, the central midfoot location is located: (a) forward, in a longitudinal direction, from the rearmost heel RH location a distance of 50% of the overall longitudinal length L of the interior midsole component 250 and (b) at a midpoint MX along a line perpendicular to the longitudinal direction and directly connecting the medial side edge 220 and the lateral side edge 222 of the interior midsole component 250 at the 50% longitudinal length location. For the central forefoot location measurement, in accordance with this aspect of the invention, the central forefoot location is located: (a) forward, in the longitudinal direction, from the rearmost heel RH location a distance of 75% of the overall longitudinal length L of the interior midsole component 250 and (b) at a midpoint FX along a line perpendicular to the longitudinal direction and directly connecting the medial side edge 220 and the lateral side edge 222 of the interior midsole component 250 at the 75% longitudinal length location. The longitudinal direction is determined by a line connecting the rearmost heel point RH and the forward most toe point FT of the interior midsole component 250. If the forward most and/or rearmost locations of a specific interior midsole component constitute line segments, then the forward most toe point and/or the rearmost heel point constitute the mid-point of the corresponding line segment. If the forward most and/or rearmost locations of a specific interior midsole component constitute two or more separated points, then the forward most toe point and/or the rearmost heel point constitute the mid-point of a line segment connecting the separated points.

Now, as some more specific examples, for interior midsole components for articles of footwear for children's shoe size 10 to youth size 3, the foam thickness in a central heel area (TH) may be from 8 to 15 mm, the foam thickness in a central midfoot area (TM) may be from 5 to 10 mm, and the foam thickness in a central forefoot area (TF) may be from 2 to 8 mm. For child sizes 5 to 10, the foam thickness in a central heel area (TH) may be from 3 to 10 mm, the foam thickness in a central midfoot area (TM) may be from 3 to 7 mm, and the foam thickness in a central forefoot area (TF) may be from 1 to 5 mm.

As shown in the example of FIGS. 2C and 2D, the top surface 252 of the interior midsole component 250 may be covered with a thin fabric or textile layer 256 (or other material), e.g., akin to a conventional footbed material of an article of footwear (e.g., the top layer or material of a conventional insole or a sock liner). The fabric or textile layer 256, when present, may be connected to the top surface 252 in any desired manner, such as via adhesives or cements, via sewing or stitching, via mechanical connectors, etc. The top surface 252 of the interior midsole component 250 may be curved or contoured, e.g., in a conventional manner, to better conform to the shape of a foot.

Other variations in the footwear construction are possible without departing from this invention. For example, the exterior midsole component may constitute a plurality of support elements, or it may include a foam material layer (e.g., made of conventional midsole foam material, such as polyurethane foams, ethylvinylacetate foams, etc.). Optionally, some portion of this exterior midsole foam layer may contain one or more fluid-filled bladders, as are conventionally known and used in footwear midsole constructions. Optionally, the exterior midsole component may include fluid-filled bladder(s), parts of which may be exposed and visible from the exterior of the shoe, e.g., through one or more openings provided in the side of the foam material layer. As yet another potential option, the exterior midsole component may constitute one or more fluid-filled bladders that are engaged with a footwear structure in some manner other than by at least partially containing them in a foam layer. Examples of these embodiments are shown in co-pending application Ser. No. 13/304,151 incorporated by reference in its entirety.

As still additional examples, if desired, the exterior midsole component in the heel area of an article of footwear (or other foot-receiving device) may constitute a more mechanical type shock absorbing device, like those illustrated, for example, in U.S. Pat. Nos. 7,314,125; 7,458,172; 7,730,635; and 7,757,410, each of which is entirely incorporated herein by reference.

Finally, as noted above, in addition to articles of footwear, interior midsole components and/or exterior midsole components of the types described above can be used with other types of foot-receiving devices (i.e., any device into which a user places at least some portion of his or her foot). In addition to all types of footwear or shoes, such foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like.

Interior midsole component 250 is insertable and removable from the shoe to allow cleaning or replacement. Interior midsole component 250 is formed of a very lightweight yet resilient material.

II. FOAM COMPOSITION

The foam material used as the interior midsole component 250 in embodiments described herein has a density of less than 0.25 g/cc$^2$. This, combined with other properties, such as a resilience of greater than 40, provides a foam material useful in applications requiring lightweight foam, such as a midsole component of footwear. As a more specific example, the foam material of the interior midsole is described in U.S. Pat. No. 7,941,938.

The foam material is prepared from a mixture of hydrogenated or non-hydrogenated acrylonitrile-butadiene copolymer; modified hydrogenated acrylonitrile-butadiene copolymer; and alpha olefin copolymer. Non-hydrogenated (standard) acrylonitrile-butadiene copolymer provides lower cost foam than hydrogenated acrylonitrile-butadiene copolymer. The non-hydrogenated acrylonitrile-butadiene copolymer generally has a higher shrinkage than hydrogenated acrylonitrile-butadiene copolymer.

After mixing and addition of other optional additives, the mixture is ultimately foamed for use as a foamed material.

Examples of hydrogenated acrylonitrile-butadiene copolymers include Zetpol 2000. Other grades of hydrogenated acrylonitrile-butadiene copolymer can be used with different percentages of polymer saturation. Typically, this copolymer is used in an amount of about 10 to about 100 parts per hundred (phr), such as about 30 to about 90 phr, or about 40 to about 70 phr.

Non-hydrogenated acrylonitrile-butadiene copolymers can be partially or fully substituted by polybutadiene, styrene butadiene, ethylene propylene diene terpolymer, chlorosulfonated polyethylene polymers, thermoplastic elastomers (TPE) can also be used to form the mixture of copolymers.

Modified hydrogenated acrylonitrile-butadiene copolymers are hydrogenated acrylonitrile-butadiene copolymers are modified with modifiers such as zinc oxide and zinc diacrylate. Suitable modified hydrogenated acrylonitrile-butadiene copolymers include ZCS 2095 (Zeon Chemicals). Typically, this copolymer is used in an amount of from 0 to about 40 phr, such as about 5 to about 40 phr, about 10 to about 30 phr, or about 15 to about 20 phr.

The alpha olefin copolymer includes an ethylene and an alpha olefin, for example having up to 20 carbon atoms, such as but not limited to copolymers of ethylene and octene-1, ethylene-methyl acrylate copolymer, and ethylene vinyl acetate copolymer. Examples of copolymers of ethylene and octene-1 include Engage products from Dow Chemical such as Engage 8480. Typically, this copolymer is used in an amount of from 0 to about 90 phr, such as about 10 to about 90 phr, about 10 to about 40 phr, or about 20 to about 40 phr.

Additives can be used to achieve the desired qualities of the foam material. These additives are added in an amount to achieve the desired result. For examples, a pigment can be added in an amount to obtain the desired whiteness or other color of the foam material. Blowing agents can be added to achieve the desired density of the foam.

Suitable elastomers can be used including polyoctenylene rubber having a high trans content. Such products are available under the trade name Vestanamer from Huls Corp. of West Germany. Particular grades of Vestanamer which are suitable are Vestanamer 8012 and Vestanamer 6213. Such elastomers can be used in a range of about 1 to about 20 phr.

Suitable homogenizing agents can be used, for example, mixtures of aliphatic hydrocarbon resins such as 60 NS by Struktol. Such additives are added in amounts to provide the desired homogenizing effect and typically in the range of about 1 to about 3 phr.

Non-reinforcing fillers can be used such as, but not limited to, calcium carbonate and magnesium carbonate. Such additives are added in amount to obtain the desired effect, typically in a range of about 1 to about 30 phr. Suitable pigments can be used such as, but not limited to, Ultramarine Blue. Such pigments are added in amount to obtain the desired effect, typically in a range of 0 to about 5 phr.

Suitable activators can be used such as, but not limited to zinc oxide. Such activators are added in amount to obtain the desired effect and typically in a range of 1 to about 5 phr.

Suitable co-agents can be used such as peroxide, SR-350, triallyl cyanurate. Such co-agents are added in amount to obtain the desired effect and typically in a range of 0 to about 10 phr.

Stearic acid can be used to internal lubricant and activator to obtain the desired effect and typically in a range of 0 to about 3 phr.

Additives to improve processing characteristics of the foam material may be used such as polyethylene wax to provide the desired processing characteristics and typically in the range of 0 to about 15 phr.

Titanium dioxide can be used along with a pigment in an amount to obtain the desired effect and typically in the range of 0 to about 20 phr. Anatase or Rutile forms of the titanium dioxide can be used.

Suitable cure system and blowing agents can be used, typically in the range of 0.5 to about 18 phr. Some chemical blowing agents can vary the gas pressures and microcellular cell structure. Suitable chemical blowing agents include modified or activated azodicarbonamides, dinitrosopentamethylene tetramine, sulfonyl hydrazides.

Suitable polymerization initiators can be used such as peroxides. Polymerization initiators are typically used in the range of about 1 to about 6 phr. Suitable peroxides include dicumyl peroxide, dibenzoyl peroxide and 2,5 dimethyl-2,5-di-(tert-butylperoxy)hexyne-3.

The following provides a table of potential ingredients to prepare the foam material. In general, the desired polymers/copolymers are combined with suitable additives and cure system and blowing agents.

| Inventive Foam | PHR (Parts per hundred) Range |
|---|---|
| Polymers | |
| Alpha Olefin Copolymer | 5-40 |
| Hydrogenated acrylonitrile-butadiene, zinc oxide, zinc diacrylate blend | 15-30 |
| Hydrogenated acrylonitrile-butadiene | 10-90 |

-continued

| Inventive Foam | PHR (Parts per hundred) Range |
|---|---|
| Additives | |
| Elastomer (Polyoctanamer) | 0-20 |
| Homogenizing agent | 1-3 |
| Non-reinforcing filler | 0-10 |
| Activator (Zinc oxide) | 0.5-3 |
| Coagent #1 | 1-5 |
| Stearic Acid | 0-2 |
| Processing Agent (Polyethylene Wax) | 0-15 |
| Titanium dioxide | 0-5 |
| Pigment (Ultramarine Blue) | 0-1 |
| Cure System and Blowing Agents | |
| Blowing Agent #1 | 1-18 |
| Blowing Agent #2 | 1-5 |
| Polymerization initiator (Dicumyl Peroxide) | 2-6 |
| Coagent #2 | 0.5-2 |

The foam can be formed as described in U.S. Pat. No. 7,941,938 or in any other suitable manner.

Example 1

The following foam material was prepared using hydrogenated acrylonitrile-butadiene.

| Inventive Foam | PHR (Parts per hundred) |
|---|---|
| Polymers | |
| Engage 8480 (Copolymer of ethylene & Octene-1) | 25 |
| ZSC 2095 (Hydrogenated acrylonitrile-butadiene, zinc oxide, zinc diacrylate blend) | 15 |
| Zetpol 2000 (Hydrogenated acrylonitrile-butadiene,) | 60 |
| Additives | |
| Vestanamer 8012 (Polyoctanamer) | 10 |
| 60 NS (Homogenizing agent) | 1 |
| CaCo3 (Filler) | 2 |
| ZnO (Activator) | 0.5 |
| SR350 (Crosslinker) | 1 |
| ST-AC (Stearic Acid) | 1 |
| AC617 (Polyethylene Wax) | 7 |
| $TiO_2$ (Titanium dioxide) | 3 |
| Ultramarine Blue | 0.4 |
| Cure System and Blowing Agents | |
| Rhenoslab AZ130-75 (Blowing Agent) | 12 |
| Blowform SH (Blowing Agent) | 2 |
| Akroform DC-40 EPR (Peroxide) | 4 |
| TAC-50 (triallyl cyanurate) | 1 |
| Cure temperature | 315 F. |
| Cure time | 20 min |
| Mold thickness | 10 mm |
| Density (g/cm3) | 0.11 |
| Appearance | Good |
| Process temp | 180-220 F. |
| Physical Properties | A |
| Durometer Asker C | 34 |
| Tensile kg./$cm^2$ | 18, 17, 19 |
| Elongation % | 313, 322, 349 |
| Tear kg./cm | 8.1, 7.6, 7.6 |
| Split Tear kg./cm. | 1.5 |
| Shrinkage | 2.9 |
| S.G._by Dimension | 0.11 |
| Compression set % | 20 |
| Resiliency | 52 |

Example 2

The following foam material was prepared using non-hydrogenated acrylonitrile-butadiene.

| Inventive Foam | PHR (Parts per hundred) |
|---|---|
| Polymers | |
| Engage 8440 (Copolymer of ethylene & Octene-1) | 35 |
| ZSC 2095 (Hydrogenated acrylonitrile-butadiene, zinc oxide, zinc diacrylate blend) | 15 |
| Nipol DN1201L (Acrylonitrile-butadiene) | 50 |
| Additives | |
| Vestanamer 8012 (Polyoctanamer) | 10 |
| 60 NS (Homogenizing agent) | 1 |
| CaCo3 (Filler) | 7 |
| ZnO (Activator) | 1 |
| SR350 (Crosslinker) | 2 |
| ST-AC (Stearic Acid) | 1 |
| $TiO_2$ (Titanium dioxide) | 7 |
| Ultramarine Blue | 1 |
| Cure System and Blowing Agents | |
| Rhenoslab AZ130-75 (Blowing Agent) | 13 |
| Akroform DC-40 EPR (Peroxide) | 4 |
| Cure temperature | 315 F. |
| Cure time | 10-12 min |
| Mold thickness | 6 mm |
| Density (g/cm3) | 0.1 |
| Physical Properties | A |
| Durometer Asker C | 24 |
| Tensile kg./cm$^2$ | 9.4, 8.7, 8.8, 10.7 |
| Elongation % | 150, 143, 148, 182 |
| Tear kg./cm | 4.4, 4.5, 4.8, 4.7 |
| Split Tear kg./cm. | 0.51 |
| Shrinkage | 5.4, 4.8 |
| S.G._by Dimension | 0.09, 0.09 |
| Compression set % | 67, 71 |

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. An article of footwear comprising, in combination:

an upper that at least in part defines an interior chamber for receiving a foot;

an insertable interior midsole component received within the interior chamber; and an exterior sole structure engaged with the upper, wherein the exterior sole structure includes: (a) an exterior midsole component with or without (b) an outsole component that extends under the forefoot region, wherein the insertable interior midsole component is formed from a foam material comprising a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer, and at least one additive in an amount suitable to form the foam material; wherein the density of the foam material is less than 0.25 g/cm$^3$, compression set of the foam material is less than 50%, and resiliency of the foam material is greater than 40%;

the footwear has forefoot region, a midfoot region, and a heel region, wherein in the heel region, the interior midsole component has a thickness of 4 to 15 mm, in the midfoot region, the interior midsole component has a thickness of 3 to 8 mm, and in the forefoot region, the interior midsole component has a thickness of 1 to 6 mm.

2. The article of footwear of claim 1 wherein the foam material comprises about 30 to about 90 phr hydrogenated or non-hydrogenated acrylonitrile butadiene copolymer, about 5 to about 30 phr modified hydrogenated acrylonitrile butadiene copolymer, and about 20 to about 40 phr alpha olefin copolymer.

3. The article of footwear of claim 1 wherein the modified hydrogenated acrylonitrile butadiene copolymer is modified with zinc oxide, zinc diacrylate, or both.

4. The article of footwear of claim 1 wherein the alpha olefin copolymer is a copolymer of ethylene and an alpha olefin having 3 to 20 carbon atoms.

5. The article of footwear of claim 4 wherein the alpha olefin copolymer is selected from copolymers of ethylene and 1-octane.

6. The article of footwear of claim 1 wherein the foam material has a density less than about 0.15 g/cm$^3$.

7. The article of footwear of claim 1 wherein the exterior midsole component comprises ethylene vinyl acetate or a blend of ethylene vinyl acetate and rubber.

8. An insertable interior midsole component comprising a foam material comprising a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer, and at least one additive in an amount suitable to form the foam material;

wherein the density of the foam material is less than 0.25 g/cm$^3$, compression set of the foam material is less than 50%, and resiliency of the foam material is greater than 40%;

the interior midsole component has forefoot region, a midfoot region, and a heel region, wherein in the heel region, the interior midsole component has a thickness of 4 to 15 mm, in the midfoot region, the interior midsole component has a thickness of 3 to 8 mm, and in the forefoot region, the interior midsole component has a thickness of 1 to 6 mm.

9. The insertable interior midsole component of claim 8 wherein the foam material comprises about 30 to about 90 phr hydrogenated or non-hydrogenated acrylonitrile butadiene copolymer, about 5 to about 30 phr modified hydrogenated acrylonitrile butadiene copolymer, and about 20 to about 40 phr alpha olefin copolymer.

10. The insertable interior midsole component of claim 8 wherein the modified hydrogenated acrylonitrile butadiene copolymer is modified with zinc oxide, zinc diacrylate, or both.

11. The insertable interior midsole component of claim 8 wherein the alpha olefin copolymer is a copolymer of ethylene and an alpha olefin having 3 to 20 carbon atoms.

12. The insertable interior midsole component of claim 11 wherein the alpha olefin copolymer is selected from copolymers of ethylene and 1-octane.

13. The insertable interior midsole component of claim 8 wherein the foam material has a density less than about 0.15 g/cm$^3$.

14. A process of preparing footwear comprising securing an exterior outsole structure to an upper having an interior chamber;

providing an insertable interior midsole component in the interior chamber of the upper and above and adjacent the exterior outsole structure;

the insertable interior midsole component comprising a foam material comprising a reaction product of about 10 to about 100 phr hydrogenated or non-hydrogenated acrylonitrile butadiene copolymer, 0 to about 40 phr modified hydrogenated acrylonitrile butadiene copolymer, and 0 to about 90 phr alpha olefin copolymer, and at least one additive in an amount suitable to form the foam material; wherein the density of the foam material is less than 0.25 g/cm$^3$, compression set of the foam material is less than 50%, and resiliency of the foam material is greater than 40%;

wherein the footwear has forefoot region, a midfoot region, and a heel region, wherein in the heel region, the interior midsole component has a thickness of 4 to 15 mm, in the midfoot region, the interior midsole component has a thickness of 3 to 8 mm, and in the forefoot region, the interior midsole component has a thickness of 1 to 6 mm.

15. The process of claim 14 wherein the foam material comprises about 30 to about 90 phr hydrogenated or non-hydrogenated acrylonitrile butadiene copolymer, about 5 to about 30 phr modified hydrogenated acrylonitrile butadiene copolymer, and about 20 to about 40 phr alpha olefin copolymer.

16. The process of claim 14 wherein the modified hydrogenated acrylonitrile butadiene copolymer is modified with zinc oxide, zinc diacrylate, or both.

17. The process of claim 14 wherein the alpha olefin copolymer is a copolymer of ethylene and an alpha olefin having 3 to 20 carbon atoms.

18. The process of claim 17 wherein the alpha olefin copolymer is selected from copolymers of ethylene and 1-octane.

19. The process of claim 14 wherein the foam material has a density less than about 0.15 g/cm$^3$.

20. The process of claim 14 wherein the exterior midsole structure comprises ethylene vinyl acetate or a blend of ethylene vinyl acetate and rubber.

* * * * *